US006453492B1

(12) United States Patent
Sturrock

(10) Patent No.: US 6,453,492 B1
(45) Date of Patent: Sep. 24, 2002

(54) SHEET FOR STRETCHER/GURNEY

(76) Inventor: Sheldon B. Sturrock, 27 Walmer Road, Richmond Hill, Ontario (CA), L4C 3W8

( * ) Notice: Subject to any disclaimer, the term of this patent is extended or adjusted under 35 U.S.C. 154(b) by 0 days.

(21) Appl. No.: 09/696,440

(22) Filed: Oct. 25, 2000

Related U.S. Application Data

(60) Provisional application No. 60/162,024, filed on Oct. 28, 1999.

(51) Int. Cl.[7] ..... A47G 9/00

(52) U.S. Cl. ..... 5/482; 5/486; 5/494; 5/495; 5/496

(58) Field of Search ..... 5/482, 486, 494, 5/495, 496, 499

(56) References Cited

U.S. PATENT DOCUMENTS

| | | | | | |
|---|---|---|---|---|---|
| 3,576,039 | A | * | 4/1971 | Roberts | 5/484 |
| 3,906,559 | A | * | 9/1975 | Bahr | 5/496 |
| 4,698,862 | A | * | 10/1987 | Mairs | 5/413 |
| 4,903,360 | A | * | 2/1990 | Friedman | 5/485 |
| 5,020,177 | A | * | 6/1991 | Etherington | 5/496 |
| 5,029,353 | A | * | 7/1991 | Kimball et al. | 5/497 |
| 5,092,010 | A | * | 3/1992 | Wong | 5/496 |
| 5,227,218 | A | | 7/1993 | Herum | |
| 5,481,772 | A | * | 1/1996 | Glynn et al. | 5/663 |
| 5,575,025 | A | * | 11/1996 | Peters | 5/482 |
| 5,615,425 | A | | 4/1997 | Corente | |
| 5,669,089 | A | * | 9/1997 | Dees | 5/419 |
| 5,749,112 | A | * | 5/1998 | Metzler | 5/663 |
| 5,950,261 | A | * | 9/1999 | Hay et al. | 5/482 |
| 6,122,783 | A | * | 9/2000 | Herndon et al. | 5/496 |

* cited by examiner

*Primary Examiner*—Lynne H. Browne
*Assistant Examiner*—James M Hewitt
(74) *Attorney, Agent, or Firm*—Dinsmore & Shohl LLP

(57) ABSTRACT

An expandable sheet for use on hospital beds, examination tables and stretchers/gurneys. The expandable sheet comprises a sheet having a length and width adapted to accommodate and be placed on the surface of an examination table, hospital bed or portable gurney/stretcher. The sheet has a width dimension and a length dimension where at least one end of the width dimension is pleated such that it is held adjacent to the surface of the examination table, hospital bed or gurney/stretcher and can be expanded over the entire examination table hospital bed or portable gurney/stretcher.

14 Claims, 3 Drawing Sheets

SHEET FOR STRETCHER/GURNEY

This application claims the benefit of U.S. provisional application No. 60/162,024, filed Oct. 28, 1999.

FIELD OF THE INVENTION

This invention relates to linens for use in emergency transportation such as for ambulance and also in hospitals. More particularly, the present invention is directed to an expandable sheet for use on a stretcher/gurney.

BACKGROUND OF THE INVENTION

Hospital sheets are typically of the kind that simply drape over the mattress of a hospital bed and must be manually folded underneath the mattress. Such sheets are also typically sized for use on hospital beds and are therefore not suitable for use on portable gurneys/stretchers.

Sheets have been specifically designed for use on portable gurneys/stretchers. For example, U.S. Pat. No. 5,227,218 discloses a cover sheet for hospital bed examination tables or portable gurneys having a pocket at each for snugly fitting around the bed or gurney. U.S. Pat. No. 5,615,425 discloses a disposable sheet fitted for use on a gurney/stretcher which has flaps on either side for the easy transportation of a patient from the gurney/stretcher and onto a hospital bed.

While such sheets are useful for providing a protective layer over a support surface of a hospital bed, examination table or portable gurney/stretcher they often have the problem of being caught within the folding mechanism of such support surfaces. Furthermore, a separate sheet or blanket is required to cover the patient which can also slip off of the support surface and get caught in the wheels or folding mechanism of the gurney/stretcher.

There is therefore a need to develop a simple and cost efficient sheet for use in covering the supporting surface of an examination table, hospital bed or gurney/stretcher which obviates at least one problem of the prior art.

SUMMARY OF THE INVENTION

In accordance with an aspect of the present invention there is provided a novel expandable sheet for use to cover the supporting surface of an examination table, hospital bed or portable gurney/stretcher. The expandable sheet comprises a sheet having a length and width adapted to accommodate and be placed on the mattress of an examination table, hospital bed or portable gurney/stretcher to prevent such mattress from being soiled, the sheet having a width dimension and length dimension and at least one end of the width dimension being pleated such that its held substantially adjacent to the mattress and can be expanded over the entire examination table, hospital bed or portable gurney/stretcher.

In accordance with another aspect of the present invention is an expandable sheet for use over the mattress of an ambulance/paramedic portable gurney/stretcher.

Preferably, the expandable sheet is pleated on both sides of the width dimension and held substantially adjacent the mattress such that the sheet can be lo expanded from either one or both sides to completely cover a patient resting on the mattress. In a preferred embodiment, the pleats are staggered so as to easily and rapidly expand the sheet on either or both sides as required.

The sheet may be fabricated to have substantially equal width and length dimensions or alternatively, a greater width dimension than length dimension or a greater length dimension than width dimension.

As provided, the expandable sheet of the present invention is kept clean and intact as it does not drag on the ground and it is kept away from the folding and portability mechanisms provided on examination tables, hospital beds and gurneys/stretchers such that it won't get caught in any such mechanisms. In this manner the sheet is kept clean and out of the way. Furthermore, the sheet can be easily grasped by emergency or medical personnel and easily expanded to cover a patient on the gurney/stretcher to keep them warm and more comfortable. The expandable portions can also be grasped by emergency or medical personnel to lift a patient from the gurney/stretcher.

The sheet of the present invention can be fabricated to be washable or alternatively and preferably, disposable. Furthermore, the sheet can be made as a layered sheet to include at least one plastic layer which is liquid impermeable and/or alternatively the sheet may also or instead include at least one padded layer for extra absorbency and additional warmth.

BRIEF DESCRIPTION OF THE DRAWINGS

A detailed description of the preferred embodiments are provided herein below with reference to the following drawings in which.

Figure 1:
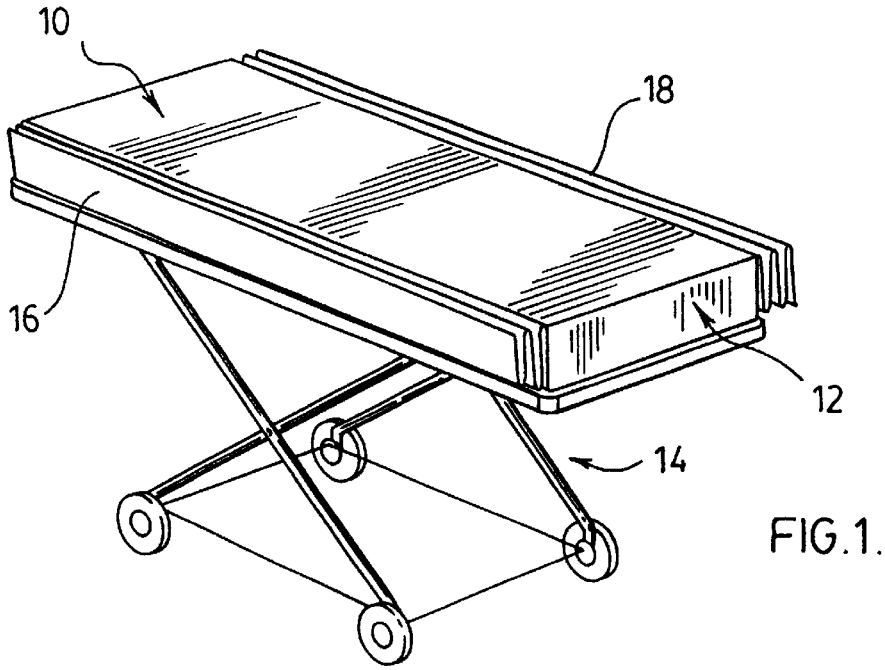
FIG. 1 is a perspective view of the sheet on a gurney/stretcher in an unexpanded condition in accordance with the present invention.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENTS

Referring now to the drawings and more particularly, FIG. 1 shows the sheet of the present invention generally indicated by reference numeral 10. The sheet 10 is shown over a conventional mattress 12 of a portable gurney/stretcher 14. The sheet 10 has pleated width side portions 16 and 18 that are held adjacent the mattress of the gurney/stretcher. It is preferred that the pleated side portions are held directly adjacent the mattress in order to provide for the easiest and fastest use of the sheet.

Figure 2:
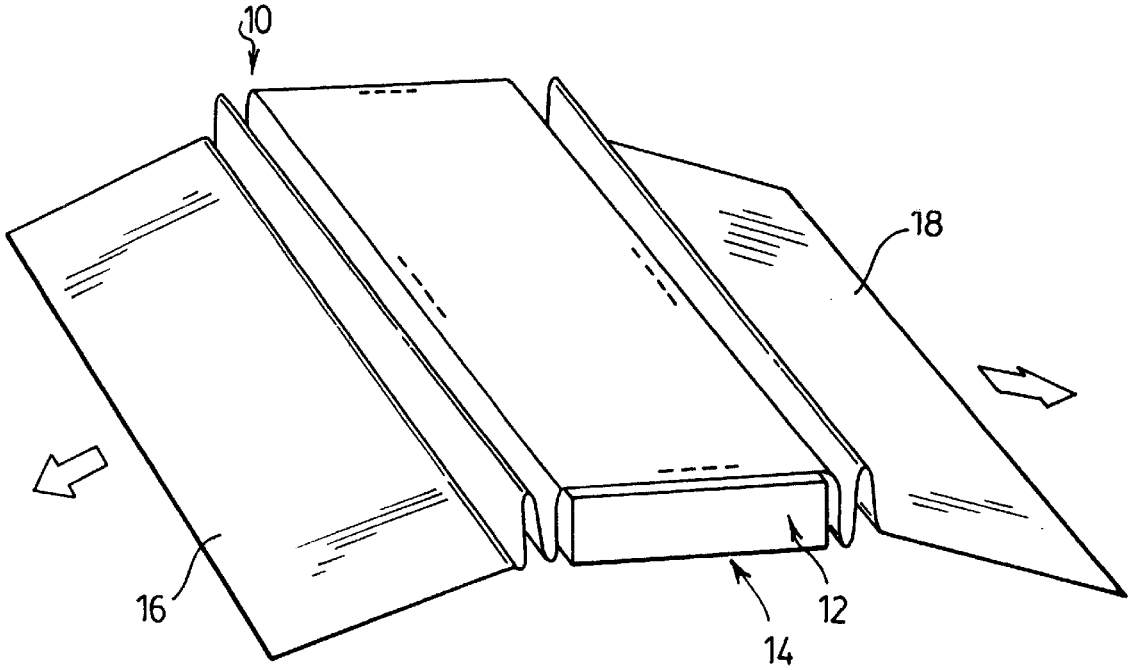
FIG. 2 is a perspective view of the sheet on a gurney/stretcher in an expanded condition in accordance with the present invention.
Figure 3A:
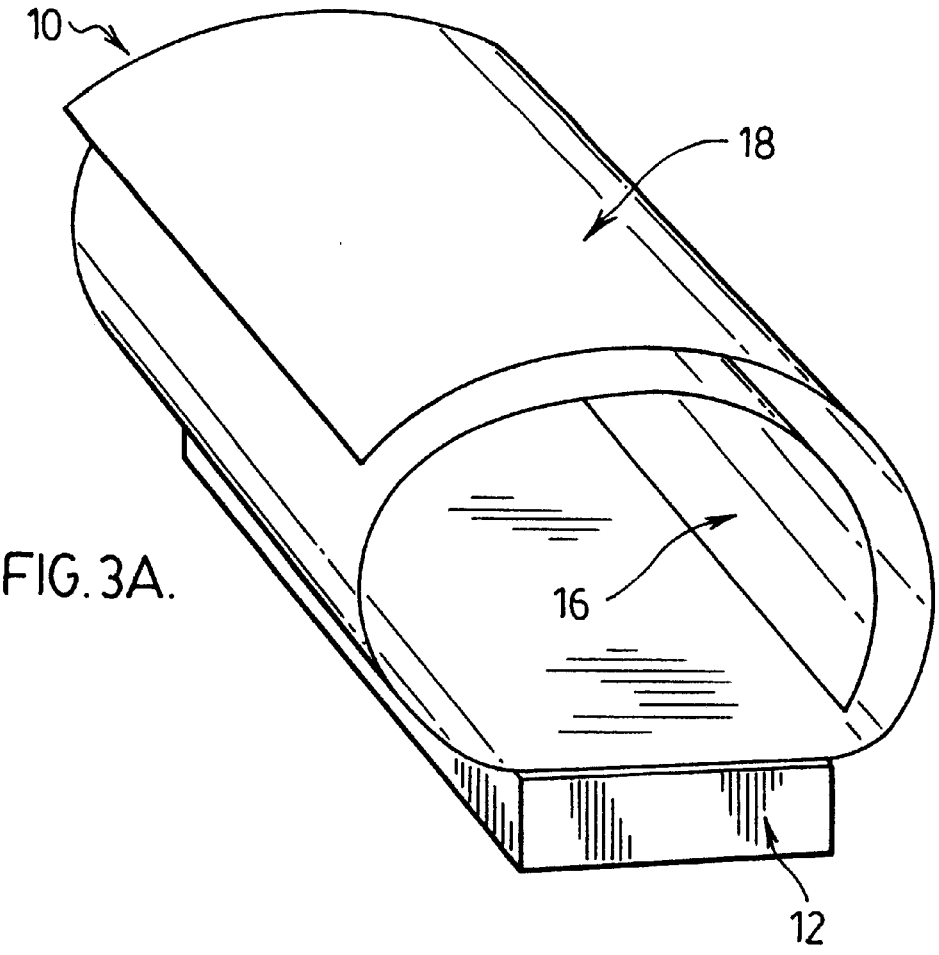
FIG. 3A is a side perspective view of the sheet on a gurney/stretcher in an expanded and folded over position in accordance with the present invention.

Now referring to FIG. 2, it is seen that the pleated width side portions 16 and 18 can be expanded such that the width of the sheet is greater than the length of the sheet. It is understood by those skilled in the art however, that the sheet may be fabricated to have a substantially equal width and length. In this manner, the width side portions can still be pleated and used as described herein. As seen in FIG. 3, the sheet 10 can be wrapped over a patient from either one or both sides such that no additional blanket or second sheet is required to keep the patient covered and comfortable. The pleated width portions can be made of varying widths from about 1" to several inches wide, so long as the pleated portion is not such that it interferes with any mechanisms present on an examination table, gurney or stretcher.

Figure 3B:
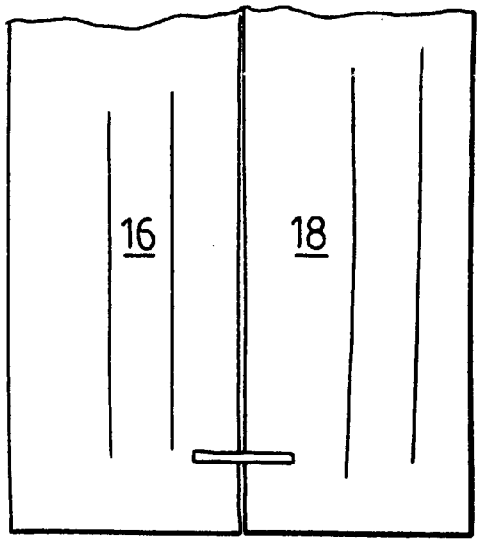
FIG. 3B is a partial top plan view of the sheet on a gurney/stretcher with each end expanded to meet and be secured together.

The sheet is convenient to use and may be either wrapped over a patient as previously described or simply be secured by any suitable type fasteners to be held to meet together. This is shown in FIG. 3B where the ends of each pleated side portion is expanded to meet and be secured together by any suitable means such as by ties, pins, Velcro™, hooks, tacks, tape and the like. In this manner, the patient is kept covered while still allowing access through vertical slit portions to his/her body for any medical attention that must be provided by the health care practitioner. The sheet of the present invention is particularly advantageous because conventional stretcher/gurney sheets are currently used in a vertical axis, that is, they are usually pulled over the patient from the feet towards the head. In the present invention, the sheet is used on a horizontal axis, that is, it is pulled from side to side over a patient. This makes it easier to cover the patient and still have access to the patients body in order to perform any required medical procedures. This also makes it easier to wrap the patient and further move the patient to another surface and location.

Figure 5:
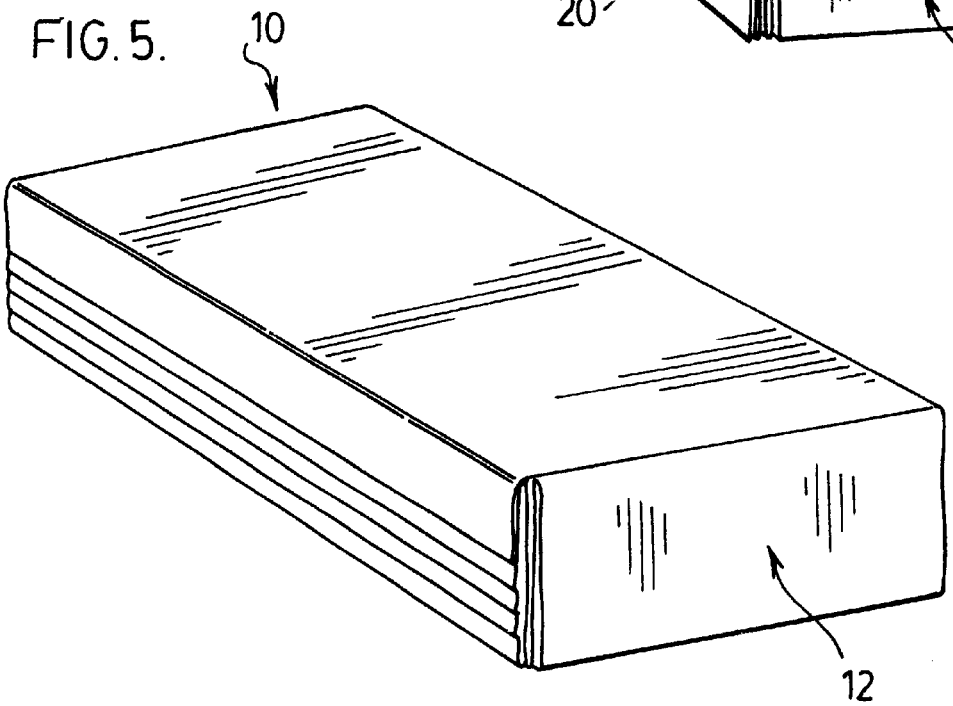
FIG. 5 is a perspective view of a preferred embodiment of the sheet of the present invention.
Figure 6:
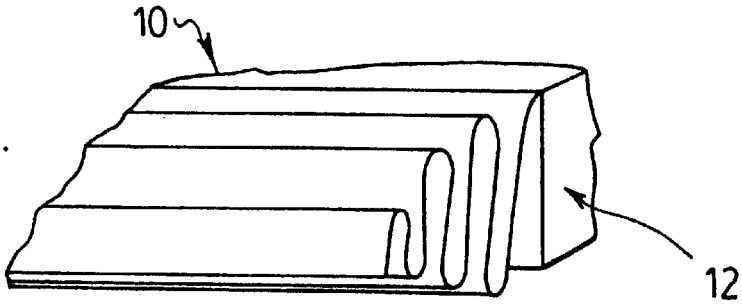
FIG. 6 is a partial perspective view of the sheet of FIG. 5.

In a preferred embodiment of the invention shown in FIGS. 5 and 6, the pleats are provided to be staggered, thus easily allowing the grasping of each end of the sheet. The staggering can be varied, that is, the size of the pleats as staggered may vary as desired. The staggering may be centrally positioned such that the pleats decrease in size centrally positioned with respect to the first pleat, or alternatively cascade in size.

It is understood by those skilled in the art that the sheet of the present invention can be made of any suitable width and length dimensions so long as the width side portions are pleated. The sheet can be fabricated in order to fit any standard type of examination table, hospital bed and/or gurney/stretcher.

It is also understood by those skilled in the art that the pleated width side portions can be held substantially adjacent the side portions of the supporting surface of the examination table, hospital bed and/or gurney/stretcher by several different methods such as for example but not limited to two way tape, clips, pins, tacks, hooks, Velcro™, and the like. The sheet may also include a means to keep it positioned on the top of a gurney/stretcher. For example, the sheet can be further secured by adhesive two-way tape or Velcro™ by additional clips or similar type fasteners. Alternatively, the sheet can have additional flaps provided at each length portion that would be placed under the mattress of the gurney/stretcher to keep the sheet in place. Such additional flaps can be elasticized to provide a secure fit over each end of the mattress. It is understood however, that additional such securing means are not required as the body of a patient keeps the sheet in place on the gurney/stretcher. Also, the pleated width side portions also help to keep the sheet in place on the gurney/stretcher.

Figure 4:
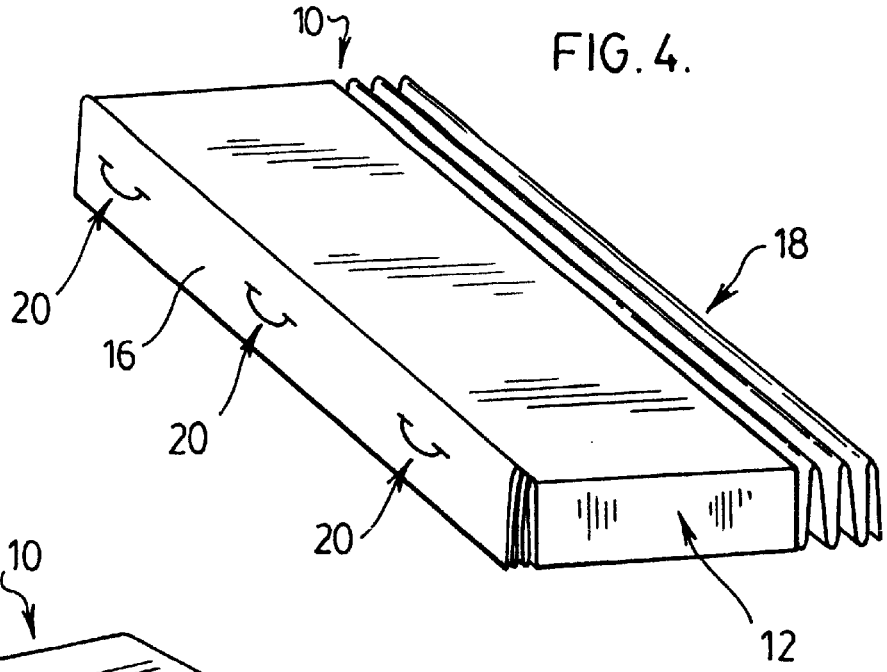
FIG. 4 is a perspective view of a further embodiment of the sheet of the present invention in an unexpanded condition.

A further embodiment of the invention is shown in FIG. 4 wherein handles 20 are provided attached to the outermost pleat of the pleated side portions. Any number of such handles can be attached via any type of stitching and/or adhesive and simply help to grab the pleated side portions of the sheet. Such handles may be made of any type of fabric or plastic.

The sheet of the present invention can be fabricated from any suitable type of material, both natural and synthetic, and as such can be made to be reusable and washable. The sheet of the present invention can also be fabricated from any type of suitable disposable fabric which may also be biodegradable. The sheet can be provided as a sterile sheet and may additionally be treated such that it contains antibacterial or anti-fungal agents and the like.

It is understood by those skilled in the art that the sheet may be layered to include one or more water resistant layers such as a plastic sheet and also be made to include one or more absorbent layers.

In summary, the present invention provides an expandable sheet for use on examination tables, hospital beds and gurneys/stretchers. The sheet is such that it is does not hang over the edges of the selected gurney for example and drag on the floor thus getting dirty or getting caught in the wheels of the gurney or in the gurney folding mechanism. In addition, the sheet can easily be pulled out and expanded over the patient to keep the patient warm and comfortable and therefore no additional sheet or blanket is required. It is also within the scope of the invention to manufacture the sheet for home use on standard mattresses of various sizes such as single, double, queen and king sized.

Although preferred embodiments have been described herein in detail, it is understood by those skilled in the art that variations may be made thereto without departing from the scope of the invention.

I claim:

1. An expandable sheet comprising a sheet having a length and width dimension adapted to accommodate and be placed on a mattress of an examination table, stretcher/gurney or hospital bed, said sheet having a width dimension and a length dimension wherein at least one end of said width dimension is pleated comprising multiple pleats, said pleated end being expandable to be substantially greater in length than said length dimension and to cover and/or wrap a patient lying on said sheet wherein said pleats cascade in size with respect to a first pleat.

2. The expandable sheet as claimed in claim 1, wherein both ends of the width dimension are pleated.

3. The expandable sheet as claimed in claim 1, wherein said sheet is layered and comprises one or more water resistant layers and/or one or more absorbent layers.

4. The expandable sheet as claimed in claim 1, wherein said pleats are held together at the side of said mattress.

5. The expandable sheet as claimed in claim 4, wherein said pleats are held by a fastener selected from the group consisting of two-way tape, clips, pins, tacks, hooks and Velcro™.

6. The expandable sheet as claimed in claim 1, wherein the sheet additionally comprises flaps at one or both vertical ends to secure to said mattress.

7. The expandable sheet as claimed in claim 1, further comprising handles attached to each end of said pleated width portion.

8. The expandable sheet as claimed in claim 1, wherein said sheet is fabricated to be reusable.

9. The expandable sheet as claimed in claim 8, wherein said sheet is fabricated to be disposable.

10. The expandable sheet as claimed in claim 1, wherein said sheet is sterile.

11. The expandable sheet as claimed in claim 1, wherein said sheet has a substantially equal width and length dimension.

12. The expandable sheet as claimed in claim 1, wherein said sheet has a greater width dimension than length dimension.

13. The expandable sheet as claimed in claim 1, wherein said sheet has a greater length dimension than width dimension.

14. The expandable sheet as claimed in claim 1, wherein said pleated end is held substantially adjacent said mattress.

* * * * *